US006584783B2

(12) United States Patent
Gopalnarayanan et al.

(10) Patent No.: US 6,584,783 B2
(45) Date of Patent: Jul. 1, 2003

(54) FLUID TRANSPORT

(75) Inventors: Sivakumar Gopalnarayanan, Tredyffrin, PA (US); Scott R. Gaboury, Whitpain, PA (US)

(73) Assignee: ATOFINA Chemicals, Inc., Philadelphia, PA (US)

( * ) Notice: Subject to any disclaimer, the term of this patent is extended or adjusted under 35 U.S.C. 154(b) by 0 days.

(21) Appl. No.: 10/254,248

(22) Filed: Sep. 25, 2002

(65) Prior Publication Data

US 2003/0019220 A1 Jan. 30, 2003

Related U.S. Application Data

(62) Division of application No. 09/592,827, filed on Jun. 13, 2000, now Pat. No. 6,470,691.

(51) Int. Cl.[7] ..... F25B 43/02; F25B 1/00
(52) U.S. Cl. ..... 62/84; 62/498; 62/468
(58) Field of Search ..... 62/84, 498, 468

(56) References Cited

U.S. PATENT DOCUMENTS 6,470,691 B1 * 10/2002 Gopalnarayanan et al. .... 62/84

* cited by examiner

*Primary Examiner*—William C. Doerrler
*Assistant Examiner*—Mark Shulman
(74) *Attorney, Agent, or Firm*—William D. Mitchell

(57) ABSTRACT

A conduit for transporting non-volatile liquids is provided in which the conduit's internal surfaces have a surface energy lower than that of the nonvolatile liquid.

12 Claims, No Drawings

FLUID TRANSPORT

This is a divisional of application Ser. No. 09/592,827, filed Jun. 13, 2000. now U.S. Pat. No. 6,470,691.

BACKGROUND OF THE INVENTION

This invention relates to conduits for transporting non-volatile liquids (such as oils or lubricants) in which the conduit's internal surfaces have a surface energy lower than that of the nonvolatile liquid so as to provide for enhanced transportability of the liquid due to de-wetting of the surface by the liquid and lack of build-up of the liquid on the surface. This invention has applicability to any internal tube, pipe or channel surface where a non-volatile liquid has to be transported by a vapor, gas, liquid or two phase vapor/liquid mixture. One such example is the transport of gas/oil mixtures through pipelines. Another example is where the conduit is in the form of a heat exchanger, especially where the heat exchanger is part of a refrigeration system. Thus, in a refrigeration system having a compressor, an evaporator heat exchanger, a condenser heat exchanger, and liquid and vapor lines, where the non-volatile liquid is a lubricant and where a refrigerant is also transported through the system, transportability of the lubricant can be enhanced by at least providing the internal surfaces of the evaporator heat exchanger with a surface energy lower than that of the lubricant. The use of this invention in such systems not only enhances the transportability of the lubricant (thus enhancing lubricant return to the compressor and reducing oil retention in the heat exchanger) but also improves the system's performance in terms of refrigeration capacity and coefficient of performance ("COP"), thus enabling the use of smaller evaporators for a specified cooling load. As used herein "refrigeration systems" include air conditioning systems.

In current refrigeration systems, a small fraction of the lubricant from the compressor is carried over and circulated through the rest of the system. Some amount of this lubricant is usually retained in the heat exchanger(s), forming a thin layer which inhibits heat transfer. Thus, excessive retention of lubricant adversely affects system performance. To minimize lubricant retention and separating out of the lubricant in the heat exchangers and connecting lines, the lubricant had to be fully miscible with the refrigerant. Further, hydrofluorocarbon (HFC) refrigerants such as 1,1,1,2-tetrafluoroethane (134a) require use of miscible polyol ester (POE) lubricants since conventional mineral oil (MO) or alkyl benzene (AB) lubricants are not miscible with HFCs. Apart from being more expensive than MO or AB lubricants, POE lubricants also require a much cleaner compressor manufacturing facility since they are hygroscopic in nature. Thus, it would be useful to find a way to enable the use of immiscible lubricants with HFC refrigerants and to enhance return of lubricant, regardless of its nature, to the compressor.

BRIEF SUMMARY OF THE INVENTION

A method for enhancing the transportability of a non-volatile liquid in a conduit (such as in the form of a heat exchanger) is provided, which method comprises providing the internal surfaces of the conduit with a surface energy lower than that of the non-volatile liquid. A preferred embodiment involves a method for enhancing the transportability of a lubricant in a refrigeration system, the refrigeration system having a compressor, an evaporator heat exchanger, a condenser heat exchanger, and liquid and vapor lines, the lubricant and a refrigerant being transported through the system, the method comprising providing the internal surfaces of the evaporator heat exchanger with a surface energy lower than that of the lubricant. Although not essential, the internal surfaces of the condenser heat exchanger and the liquid and vapor lines can also be provided with a surface energy lower than that of the lubricant. In one embodiment, the internal surfaces of the system's heat exchangers and, optionally, other system components will have a surface energy greater than that of the refrigerant to enable wetting of the surface by the refrigerant, making it easier for the refrigerant flow to push the lubricant along the surface of the heat exchangers. In another embodiment, however, the condenser heat exchanger can be provided with a surface energy which is lower than that of the refrigerant to promote drop-wise condensation and thus enhance heat transfer.

In refrigeration systems, the non-volatile liquid(s) include conventionally used lubricants, such as MO, AB, POE, polyalkyl glycol, and polyvinyl ether, as well as additives used to enhance system performance, such as tetraglyme. The refrigerants include fluorocarbons, ammonia, carbon dioxide, and hydrocarbons. A typical refrigerant is 134a.

DETAILED DESCRIPTION

It has now been found that the transportability of a non-volative liquid in a conduit can be improved by providing the internal surfaces of the conduit with a surface energy lower than that of the non-volatile liquid.

The desired surface energy can be achieved by any of several known methods for altering the surface energies of solids. Examples are chemical surface modification, such as direct fluorination of a metal surface, or application of a thin organic or additive-containing composite coating. An example of a composite coating is Ni-flor, a nickel-phosphorous matrix containing polytetrafluoroethylene particles which is available from Atotech Inc. Organic coatings include polymers such as polyethylene, polypropylene, polystyrene, polymethyl methacrylate, polyethylene terephthalate, nylon 6, polydimethylsiloxane, polycarbonate of bisphenol-A, polyheptafluoroisopropyl acrylate, polytetrafluoroethylene, polyvinyl fluoride, polychlorotrifluoroethylene and polyvinylidene fluoride, the latter polymer having been found to be particularly useful for refrigerant applications where the surface is commonly copper, aluminum or steel. Polyvinylidene fluoride ("PVDF") as used herein refers not only to the homopolymer of vinylidene fluoride ("VDF") but also to copolymers prepared from at least about 85 weight % VDF monomer and up to about 15 weight % hexafluoropropylene (HFP). Examples of such polymers include Kynar® 741 (polyvinylidene fluoride), Kynar Flex® 2801 (a VDF/HFP copolymer containing about 10% HFP) and Kynar Flex 2751 (a VDF/HFP copolymer containing about 14% HFP), available commercially from Elf Atochem North America, Inc. of Philadelphia, Pa. Some HFP (up to about 15% by weight) is useful in the PVDF because having HFP present in the monomer blend makes the coating easier to solution cast and contributes to flexibility and elasticity of the polymer, thereby enabling the coating to adhere to the internal surfaces as they elongate or contract during temperature cycling. Since HFP also has a lower surface energy (about 16 dyn/cm) than VDF, it can also be used to customize the polymer's surface energy. On the other hand, more than 15% HFP is preferably avoided in order to minimize mass gain through contact with the refrigerant and lubricant.

Surface energies for the foregoing types of organic polymers can be found in the Table of Surface Energies for Common Polymers in the Polymer Handbook: 3rd Edition, Wiley, 1989. For example, the preferred polyvinylidene polymers typically have a surface energy at 20° C. in the range of 25–32 dyn/cm (dynes/centimeter), while a refrigerant such as 134a has a surface energy of about 1.5 to 19 dyn/cm over a temperature range of from about 80° C. to about −50° C., a typical MO used in refrigeration applications has a surface energy of about 47 dyn/cm at room temperature, and AB oils have a typical surface energy in the range of 35 to 45 dyn/cm at room temperature. Accordingly, use of a PVDF coating in a refrigeration system application will inhibit wetting of the interior surfaces by the lubricant but permit wetting by the refrigerant. Tests done on the Ni-flor composite show it also has a surface energy in the desired range, about 15–30 dyn/cm.

A relatively thin coating (desirably no more than about 2 microns) is preferred in order to minimize altering the system's thermal performance (heat transfer) and to improve adhesion. Methods of applying coatings to metal surfaces are well-known, such as spray, dip or curtain coating.

The practice of the invention is illustrated in more detail in the following non-limiting examples.

EXAMPLE 1

This example used coated and uncoated heat exchanger coils made either of copper or aluminum tube with an outside diameter of 0.25 inch, a length of 60 inches and an inside diameter of either 0.167 inch (the aluminum coils) or 0.163 inch (the copper coils). Coated coils were developed by applying a 5% solids solution of Kynar Flex 2801 in acetone; the coated coils were baked in an oven at 165° C. for about thirty minutes. Each coil was charged with 10 grams of lubricant (MO having a viscosity of 150 SUS (Saybolt Universal Seconds) and placed in a constant temperature bath maintained at 60° F. (16° C.). A steady liquid 134a flow rate of about 15 grams/minute was maintained through the coil. The amount of oil remaining in the coil was measured after 6 minutes of flushing. Results were as follows:

(A) Aluminum Tubes: After flushing, only 7% of the oil remained in the coated tube while about 40% of the oil remained in the uncoated tube.

(B) Copper Tubes: After flushing, only 20% of the oil remained in the coated tube while about 40% of the oil remained in the uncoated tube.

EXAMPLE 2

This Example was carried out using a refrigeration loop with both coated and uncoated heat exchangers. The evaporator heat exchanger for this refrigeration system was located inside an insulated box while the condenser heat exchanger and the compressor were located above the evaporator outside of the insulated box. Two additional heat exchangers, one for the evaporator and one for the condenser that are identical to the original heat exchangers, were used wherein the internal surfaces were provided with a thin coating of Kynar Flex 2801 using a 1 weight % solution in N-methyl-2-pyrrolidone (NMP). The configuration forced the lubricant to flow against gravity to return to the compressor, exacerbating any difference in oil return between miscible and immiscible lubricants. The expansion device was a combination of a needle valve in series with a capillary tube; this allowed a wide range of pressure control in the evaporator. Two heater bands were located inside the refrigerated box—one fixed heater of about 900 watt capacity and the other controlled with a rheostat to span 0 to 900 watts. The refrigerant side temperatures and pressures at the evaporator inlet and outlet, compressor suction and discharge, air temperature inside the box, compressor power consumption and heater power consumption were measured and recorded.

Tests were carried out for two different conditions. In the first, representing air conditioning applications, the box air temperature was maintained at 45° F. (7° C.) and the refrigerant superheat at the evaporator outlet at 10° F. (6° C.). In the second, representing refrigeration application, the box air temperature was maintained at 12° F. (−11° C.) and the refrigerant superheat at the evaporator outlet at 8° F. (4° C.). For the second test condition, the system was defrosted once after about 10–12 hours of running. For all the tests, the ambient temperature was maintained at 85° F. (29° C.). For the low temperature tests, the room relative humidity was maintained between 15 and 25%. For both test conditions, the system was run for two different durations (about 25 hours and about 50 hours). At the end of each test, the heat exchangers were isolated and the amount of refrigerant and the amount of lubricant inside the condenser and the evaporator were measured.

The refrigerant was 134a.

Oil Retention Results—Oil Retained In Evaporator & Condenser: The evaporator results confirm the results in Example 1 that the coated heat exchanger retains significantly less lubricant (mineral oil) than the uncoated heat exchanger, at either −11° C. or 7° C. (the amount of mineral oil retained in the coated evaporator at −11° C. and 7° C. was, respectively, about 80% and 50% less than that in the uncoated evaporator). However, as expected due to the higher temperature in the condenser (the condensing temperature was about 32° C.), no dramatic differences were noted in the amount of lubricant (mineral oil) retained, the amount retained being low in all cases. These results confirm the conclusion that significant performance benefits are obtained by coating the evaporator, but that only marginal benefits are obtained by coating the condenser.

System Performance: At −11° C., the performance of the system with coated heat exchangers and a 134a/MO combination, both in terms of evaporator capacity and COP, was significantly better than both uncoated heat exchangers using 134a/MO (about a 15–25% improvement) and a conventional system with uncoated heat exchangers using 134a and the miscible POE lubricant (at least about a 5% improvement).

At 7° C., the performance of the system with coated heat exchangers and a 134a/MO combination, in terms of evaporator capacity, is again significantly better than the uncoated heat exchangers using 134a/MO (about a 5% improvement) and is slightly better than, or at least equal to, a conventional system with uncoated heat exchangers using 134a and the miscible POE lubricant.

At 7° C., the performance of the system with coated heat exchangers and a 134a/MO combination, in terms of COP, is significantly better than the conventional system with uncoated heat exchangers using 134a and the miscible POE lubricant (about a 5% improvement) and about equal to that of an uncoated heat exchangers using 134a/MO.

We claim:

1. A method for enhancing the transportability of a lubricant in a refrigeration system, the refrigeration system having a compressor, an evaporator heat exchanger, a condenser heat exchanger, and liquid and vapor lines, and wherein the lubricant and a refrigerant are transported through the system, the method comprising providing the internal surfaces of the evaporator heat exchanger with a surface energy lower than that of the lubricant.

2. A method as in claim 1 wherein the internal surfaces of the condenser heat exchanger and the liquid and vapor lines are also provided with a surface energy lower than that of the lubricant.

3. A method as in claim 1 wherein the internal surfaces of the evaporator heat exchanger are provided with a surface energy that is lower than that of the lubricant but higher than that of the refrigerant.

4. A method as in claim 3 wherein the internal surfaces of the condenser heat exchanger is provided with a surface energy lower than that of the lubricant and the refrigerant.

5. A method as in claim 1 wherein the internal surfaces of the evaporator heat exchanger are coated with an organic coating having a surface energy lower than that of the lubricant.

6. A method as in claim 5 wherein the coating is a polyvinylidene fluoride.

7. A conduit for transporting a non-volatile liquid in which the conduit's internal surfaces have a surface energy lower than that of the non-volatile liquid.

8. A conduit as in claim 7 wherein the conduit is in the form of a heat exchanger.

9. A refrigeration system having a compressor, an evaporator heat exchanger, a condenser heat exchanger, and liquid and vapor lines, wherein a lubricant and a refrigerant are transported through the system, and wherein the evaporator heat exchanger's internal surfaces have a surface energy lower than that of the lubricant.

10. A refrigeration system as in claim 9 wherein the internal surfaces of the condenser heat exchanger also have a surface energy lower than that of the lubricant.

11. A refrigeration system as in claim 9 wherein the internal surfaces of the evaporator heat exchanger have a surface energy lower than that of the lubricant but higher than that of the refrigerant.

12. A refrigeration system as in claim 11 wherein the internal surfaces of the condenser heat exchanger have a surface energy lower than that of the lubricant and the refrigerant.

* * * * *